United States Patent [19]

Knappworst et al.

[11] 4,175,492

[45] Nov. 27, 1979

[54] PROJECTILE, PARTICULARLY FOR HAND FIREARMS AND LONG FIREARMS

[75] Inventors: Jürgen Knappworst; Uwe Brede, both of Fürth; Erich Zeiher, Fürth-Vach, all of Fed. Rep. of Germany

[73] Assignee: Dynamit Nobel, AG, Fed. Rep. of Germany

[21] Appl. No.: 846,546

[22] Filed: Oct. 28, 1977

[30] Foreign Application Priority Data

Oct. 30, 1976 [DE] Fed. Rep. of Germany ..... 2650136
Jun. 22, 1977 [DE] Fed. Rep. of Germany ..... 2728040

[51] Int. Cl.[2] ..... F42B 11/10

[52] U.S. Cl. ..... 102/92.6; 102/91; 102/DIG. 10

[58] Field of Search ..... 102/91, 92.1, 92.6, 102/92.7, DIG. 10

[56] References Cited

U.S. PATENT DOCUMENTS 3,580,179 5/1971 Gawlick ..... 102/92.7
3,726,495 4/1973 Gawlick ..... 102/92.7

FOREIGN PATENT DOCUMENTS 308434 2/1920 Fed. Rep. of Germany ... 102/DIG. 10

*Primary Examiner*—Verlin R. Pendegrass
*Attorney, Agent, or Firm*—Craig and Antonelli

[57] ABSTRACT

A projectile, especially for hand and long firearms, including a projectile body having a longitudinal axis, a front face and a rear face, a deformation cavity extends partially into the projectile body at the front face thereof and a continuous axial bore is provided in the projectile body in communicating relationship with the rear face and the deformation cavity. The projectile body has a wall thickness in the region surrounding the deformation cavity which is smaller than the wall thickness in the region surrounding the axial bore. A cap is initially disposed in the region of the front face of the projectile body for covering at least the deformation cavity, the cap being separated from the projectile body within the barrel of the firearm during firing of the projectile and exiting from the barrel in front of the projectile body.

29 Claims, 10 Drawing Figures

PROJECTILE, PARTICULARLY FOR HAND FIREARMS AND LONG FIREARMS

The present invention relates to a projectile, especially for hand firearms and long firearms having a continuous, axial bore closed off by a forward cover or cap connected to the projectile with the cover being separated from the projectile during firing within the barrel of the firearm and exiting from the barrel in front of the projectile.

Special requirements must be met by projectiles usable, in particular, for the police in the combating of lawbreakers. Such projectiles must display, even at varying firing distances, a satisfactory shelling action, i.e., a high energy transfer to the target body, while minimally endangering any innocent persons present behind and/or in close proximity of the lawbreaker. However, at the same time, these projectiles must be capable of penetrating even solid targets, such as vehicle bodies, and then must still possess enough energy to render the passenger immediately unfit for combat upon impingement. The projectiles are to be maximally universal in their usefulness for police purposes, and they are to ensure a flawless and optionally also automatic firing function in all types of handguns and long firearms in use but also in machine guns, etc., and they must exhibit a high firing output.

The solid-jacket projectiles nowadays employed by the police for combating lawbreakers have a relatively low energy transfer characteristic. The lawbreaker, after having been hit, is frequently still capable of acting for some period of time so that he can injure or kill his adversaries, hostages, or innocent bystanders with his weapon. Another disadvantage of these police projectiles is that such a projectile after passing through a soft target, for example a body part, still displays such a large amount of residual energy that it can still injure or even kill innocent bystanders present behind the lawbreaker who has been shot.

In contrast to these solid-jacket projectiles, partial-jacket projectiles possess a sufficiently high energy transfer to the target body in case of soft targets. These partial-jacket projectiles consist, in principle, of a forwardly open projectile jacket wherein a lead core with a hollow tip is disposed. However, a disadvantage in these projectiles is the fact that they are greatly deformed when impinging on hard targets, such as automobile bodies, doors, or the like, leading to the production of undesired shell fragments and, in certain cases, also to a separation of jacket and core, whereby the penetration effect is correspondingly diminished. The danger of fragmentation, by the way, is also present in the case of soft targets, if the partial-jacket projectile hits a bone, resulting in extremely grave and therefore undesirable gunshot wounds.

It is therefore an object of the present invention to provide a projectile intended particularly for hand firearms and long firearms which overcomes the aforementioned disadvantages.

It is another object of the present invention to provide such a projectile which combines the advantages of solid-jacket and partial-jacket projectiles, without, however, displaying their disadvantages, so that it can be employed with maximum versatility especially for police use against lawbreakers. The projectile of this invention thus is to be deployable against soft targets as well as hard targets with equally good effects.

In accordance with another object of the present invention, the projectile is provided with a firing efficiency to ensure a sufficiently high hit probability and furthermore displays flawless functioning in all types of firearms, including automatic weapons.

To attain these objectives, the present invention starts with conventional training projectiles (see German Pat. Nos. 1,453,827 and 1,578,103), provided with a continuous axial bore covered at the front end with a cap or cover which supplements the training projectile preferably so that it has the appearance of a live shell. This cap is separated from the projectile during firing while still in the barrel of the firearm, is optionally disintegrated during this process, and is ejected as one piece or in fragments from the barrel of the firearm in front of the projectile. By way of the thus-vacated, continuous bore in the training projectile, a portion of the propellant gases can then flow off unused toward the front, while the projectile is still in the barrel of the firearm. This makes it possible to reduce the range of the training projectile in a controlled fashion to a greater or lesser extent, which feature is desirable in view of the utilization of training ranges with as small an area as possible.

The present invention then provides that the projectile includes a deformation cavity extending from its forward end face toward the rear and being covered by the cap, the wall thickness of the projectile being substantially smaller in the zone of the deformation cavity than in the region of the axial bore arranged behind the deformation cavity in conjunction with the principle known from training ammunition, namely, that the front cap of the projectile is still separable within the barrel of the firearm. The cap is preferably constructed so that it supplements the projectile of the invention with a shape corresponding to the external configuration of the projectile otherwise fired from the respective firearm. The handling and feeding of ammunition comprising the projectile of this invention therefore corresponds to the procedure used with ammunition heretofore employed in the firearms, so that there will be no disturbances, for example, when feeding the cartridges from the magazine into the cartridge chamber. Consequently, flawless functioning is ensured in automatic firearms, such as pistols, machine guns, and rapid-firing guns. This flawless functioning of the weapon is of utmost importance for police deployment.

According to the present invention, the projectile is provided with deformation cavity at its front end which is preferably in the shape of an indentation with rotational symmetry. As seen in cross section, the indentation can have the configuration, for example, of a circular arc, part of an oval, or of some other curvature. By providing this deformation cavity, it is made possible on the one hand that the material of the target body can, for example, in the case of soft targets, penetrate into the cavity and thus partially into the projectile. On the other hand, due to the geometrical shape and dimensions of the deformation cavity in conjunction with the external shape of the projectile, a certain thickness of the projectile wall is provided in the zone of the deformation cavity, which preferably becomes larger toward the rear end, i.e., toward the base of the deformation cavity. This thickness of the projectile wall is, according to the invention, substantially smaller than the thickness of the projectile wall in the zone of the continuous axial bore. The term "substantially smaller" means that, considering the deformability of the material of the projectile, the mass and the speed of the projectile, etc., the projectile will be subject upon impingement on soft targets to a substantial enlargement in cross section in that it is radially expanded in the zone of the deformation chamber under the influence of the radial pressure forces of the target material accumulating in the deformation chamber. In contrast thereto, the projectile of this invention, due to the adapted wall thicknesses, will be expanded only to a minor extent when hitting hard targets, since the material of the hard target body will penetrate to a lesser extent into the deformation cavity. Instead, the projectile will then be axially compressed to an increased degree in the zone of the deformation cavity. In both cases, the remaining part of the projectile body encompassing the axial, continuous bore, which has a relatively small inside cross section as compared to the deformation cavity, will be subject to practically no deformation at all, or only a very small deformation.

The deformation cavity arranged at the front end of the projectile according to this invention therefore ensures that the projectile, when impinging on soft target bodies, as they can be represented in an experiment, for example, by a block of gelatin, increases its cross-sectional area to a substantial degree, to attain a maximum energy transfer to the target body. As a consequence thereof, the projectile, after penetrating perhaps through the target body entirely, has only a minor residual energy so that it can neither gravely injure nor kill any innocent bystanders present in the vicinity, for example. Besides, the projectile, when impinging on hard targets, for example, vehicle bodies, will be increased in cross section only insubstantially, since the deformation cavity is formed essentially only in an axial direction, so that a great penetrating power is obtained. It has been found under practical conditions that this penetrating power is comparable to that of conventional solid-jacket projectiles.

The projectile of this invention is preferably fashioned as a solid-type projectile, i.e., it does not have an additional jacket. However, basically, it is also possible to provide such additional jacket if this should prove advantageous in a particular case. The jacket-free solid projectile as preferred according to this invention hits the target as a solid metallic body. Due to its great deformation tendency, a fragmentation upon impingement on hard parts, such as bones, for example, is entirely avoided, so that the projectile body retains its original weight. Since the cover protecting the deformation chamber during handling, transportation, feeding into the cartridge chamber, etc., is already separated from the projectile within the barrel of the firearm, i.e., is no longer attached to the projectile when it hits the target, the cover cannot impede the deformation characteristic of the projectile and thus influence the same adversely.

The projectile of this invention, utilized particularly for calibers from about 4 to 12 mm., is advantageously of a very simple structure, so that the expense for its manufacture is comparatively low. The projectile body is preferably made of a tough, not brittle metal or metal alloy, especially a copper alloy, such as tombac, for example. Brittle metals are less suitable, since any broken metal pieces which may occur during the deformation process are undesirable. However, furthermore usable are, depending on the particular application, optionally soft-annealed brass, lead, or also relatively soft iron or steel.

The cap or cover protecting the deformation chamber until the instant of firing against damage, the penetration of foreign bodies, moisture, etc., completes the projectile of this invention preferably to a shape corresponding to the projectiles heretofore fired from the respective firearm. The cover has no function from the viewpoint of external ballistics., i.e., it does not affect the flight behavior of the projectile. For the reason, the cover can be made of a great variety of materials, insofar as such materials withstand the stresses until firing. Preferably, the cover is made from a thermoplastic synthetic resin, such as PVC, polyethylene, or the like.

The cap has such a configuration, for example—optionally by fashioning it as a hollow tip—that it is disintegrated into individual pieces under the action of the propellant gases during firing, while still in the barrel of the firearm or after exiting therefrom with these pieces being laterally deflected relatively quickly out of the flight path of the projectile and thus do not impair the projectile in its flight characteristic. Due to their comparatively small mass and accordingly low ballistic coefficient, the pieces of the cap drop without energy to the ground at a distance of a few meters in front of the barrel of the firearm, while the projectile continues its flight to the target.

The cap is joined to the projectile preferably by a frictional connection, for example, by extending over the outside of the projectile with a correspondingly tight fit or by being pressed into a bore of the projectile by means of a pin. Instead of such a clamping connection, or also in addition thereto, it is also possible, however, to provide a snap, screw, cemented, or other connection. The connection must only meet the requirement that the cap will be separated from the projectile within the barrel of the firearm under the effect of the propellant gases.

The inside cross section of the axial, continuous bore is preferably constructed small so that a minimum amount of gas exits toward the front, i.e., merely sufficient to effect the separation of the cover, in order to attain a maximally high speed of the projectile at the mouth of the barrel. In contrast to the conventional training projectiles, it is undesirable in the projectile of this invention, which is a genuine combat projectile, to reduce the speed of the projectile by an intentional, relatively vigorous escape of the propellant gases through the projectile. Accordingly, the projectile of this invention definitely possesses a sufficiently high target velocity and target effect within the ranges prescribed for police use. Over larger distances, the flight range of the projectile of this invention and thus the danger to bystanders in the rear area of being hit by the projectile, is advantageously reduced due to the higher drag caused by the provision of the deformation cavity, as compared to conventional projectiles.

In accordance with a feature of the present invention, the deformation chamber is shaped at least substantially cylindrical. This makes it possible in a very simple manner to adapt the deformation characteristic at various calibers and/or cartridge types extensively to the respective speed of the projectile, in order to attain a maximally favorable target effect. The capacity of controlling the deformation characteristic of the front end of the projectile is in such a case generally more advantageous than in the case of deformation chambers having a curved wall, since in the latter case the thickness of the projectile wall increases relatively strongly in the zone of the deformation chamber toward the rear.

According to another feature of the present invention, the deformation chamber is preferably configured to have at least substantially the shape of a truncated cone, flaring in the forward direction. This provides an even better adaptation of the deformation characteristic to the respective requirements. The angle of inclination with respect to the longitudinal axis of the projectile can be up to about 30°, but can also be larger in individual cases. However, an angle of inclination of between about 5° and 15° is preferred.

It is advantageous to determine the optimum dimensions of the deformation chamber in dependence on the caliber and/or cartridge type, the projectile velocity, the cross section of the axial, continuous bore, the projectile material, the external shape of the projectile, etc., in each particular case. It has been found to be advantageous for cylindrical deformation chambers and those having the shape of a truncated cone to provide that the smallest inside diameter of the deformation chamber and the caliber of the projectile have a relationship of approximately 0.25:1 to 0.75:1.

However, other relationships can prove to be advantageous as well, depending on the effect of the aforementioned parameters. It is normally also advantageous to provide that the smallest inside diameter of the deformation chamber has a relation to the inside diameter of the axial, continuous bore of about 3:1 to 6:1. Here again, however, deviations in the upward or downward direction are possible in certain cases. In the case of a deformation chamber having the shape of a truncated cone, the smallest inside diameter corresponds to the diameter of the base. The description of "essentially cylindrical or essentially of the shape of a truncated cone" means, for example, that also certain rounded portions can be located at the base and/or at the front end of the deformation chamber, for example, to avoid sharp-edged transition zones.

According to a further feature of the present invention, the deformation chamber is provided with a base surface oriented at right angles to the longitudinal axis of the projectile. This rearward, vertical end surface has the effect, especially when firing at soft targets, that the material of the soft body target penetrating into the deformation chamber has practically no deforming effect at all on the rear portion of the projectile, but rather enhances the radial expansion of the front end of the projectile.

According to another feature of this invention, the axial, continuous bore is not permitted to have a direct transition into the deformation chamber, but rather is separated therefrom by a transition portion having an intermediate inside cross section, i.e. the diameter of which is larger than that of the continuous bore, but smaller than the smallest diameter of the deformation chamber. This transition section preferably has a cylindrical shape. In the recess of this transition section, the cap is held preferably by a friction fit with the aid of a pin formed at the cap. The transition bore can optionally also serve as an additional influence on the deformation characteristic, depending on the selection of the inside cross section of this transition bore.

Another advantage provided by the projectile of the present invention resides in that, due to its forward, annular edge, which is relatively narrow and optionally also very sharp, a circular disk is punched out of car tires by the projectile when fired in that direction, so that the air will immediately escape from the tire with the vehicle being quickly forced to stop. Conventional projectiles fired on car tires, in contrast thereto, frequently do not cause a hole in the tire material of sufficient size for the air to escape right away. Thus, the vehicle cannot be forced to stop quickly and will continue its ride for a certain distance sufficient for lawbreakers to flee.

As has been found under practical conditions, it is possible under adverse circumstances, especially when using long firearms, for the separation between cap and projectile within the barrel to take place at such a late point in time that the cap can affect the flight path of the projectile disadvantageously after exiting from the barrel, resulting in a reduced firing accuracy.

Therefore, a feature according to the present invention provides that the separation between the cap and the projectile takes place as early as possible in the barrel of the firearm. That is, the projectile is provided with an intake section for the propellant gases in the region of its rear end and the inlet opening of this intake section on the bottom side of the projectile is constructed larger than the inside cross section of the axial bore. Further, the inside cross section of this intake section decreases starting from the bottom of the projectile toward the front, preferably in a constant fashion, to the size of the inside cross section of the axial bore.

The intake section according to the present invention, acting along the lines of an intake nozzle, thus favors advantageously the early influx of the propellant gases into the axial bore because the intake section imparts a higher velocity to the gases flowing therethrough. Consequently, an earlier separation of the cover from the projectile is achieved, than possible with the same inside cross section of the bore without such intake section. With this special configuration of the end of the projectile at the rear or bottom portion, there is normally no longer any impairment of the flight path of the projectile by the separated cap. It proved to be advantageous for the intake section of this invention to dimension the size of the inlet opening of the intake section on the bottom side in relation to the dimension of the axial bore. For example, the ratio of the diameter of the inlet opening of the intake section on the bottom side to the diameter of the axial bore should be between about 1.5:1 and 4.5:1, preferably about 2.5:1 to 3.5:1. The bore proper will generally be made the larger, the larger the caliber of the projectile. The ratio of projectile caliber to inside diameter of the bore is suitably between 3:1 and 7:1, preferably about 4.5:1 to 5.5:1.

The intake section can be fashioned with a curved wall, if a particularly advantageous flow characteristic is to be required in this "intake nozzle." However, a configuration wherein the intake section is constructed with a conical wall is preferred, since it can be realized in a particularly simple manner from a manufacturing standpoint. In this intake cone, inclination angles in ($\beta$) of the conical surface with respect to the longitudinal axis of the projectile of between about 25° and 65°, preferably about 35° to 55° proved to be advantageous.

Furthermore, it was found to be especially advantageous, in addition to the intake section according to the present invention, to construct the cap for the deformation cavity such that the cap has a center of gravity lying outside of the longitudinal axis of the projectile so that due to the eccentric position of the center of gravity, an even faster lateral deflection of the cap can be attained. That is, the trajectories of cap and projectile are separated from each other as early as possible. However, this measure of eccentric positioning can be utilized, if desired, even without including the intake section of the present invention. In a variation of the cap described hereinabove, wherein the cap is disintegrated into fragments under the effect of the propellant gases, the cap in such embodiment is ejected in its entirety from the barrel in front of the projectile.

The eccentric position of the center of gravity can be attained, for example, by arranging in the cap, which is preferably made of a thermoplastic synthetic resin such as PVC, polyethylene, or polystyrene, locally a material of higher density, e.g. a metal such as lead. However, an arrangement wherein the cap has a cross section deviating from rotational symmetry is preferred, which can be manufactured in an especially economical manner. For this purpose, the cap is preferably provided with an inner cavity open toward the rear and encompassing the holding pin of the cap along part of its periphery, for example, between about 30° and 330°. By the internal arrangement of the hollow space, the cap retains its outer configuration in correspondence with the respective, conventional projectile. However, basically, an eccentrically arranged, external longitudinal notch could also be provided, for example.

These and further objects, features and advantages of the present invention will become more obvious from the following description when taken in connection with the accompanying drawings which show, for purposes of illustration only, several embodiments in accordance with the present invention; and wherein FIG. 1*a* shows the projectile in a longitudinal sectional view without a cap;

FIG. 1*b* shows the projectile in sectional view with a cap inserted therein illustrated in plan view;

Figure 1A:
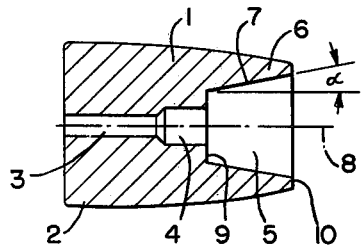
Figure 2:
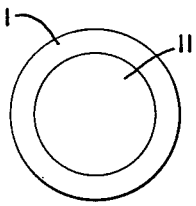
FIG. 2 is an end view of the projectile in the direction of arrow A in FIG. 1*b;*

Referring now to the drawings wherein like reference numerals are utilized to designate like parts throughout the several views, there is shown in FIG. 1*a* a projectile including a projectile body 1 with a rear or bottom portion 2. An axial, continuous bore 3 acting as a nozzle extends from the rear through a transition zone 4 and into a deformation chamber 5 which is surrounded by a deformable zone 6. The solid-projectile body 1 without a jacket is preferably made of a relatively readily deformable material, especially metals with copper alloys. The lateral wall 7 of the deformation chamber 5 is constructed in the shape of a truncated cone surface which flares in the forward direction and having an angle of inclination $\alpha$ with respect to the longitudinal direction or longitudinal axis 8 of the projectile of about 15°. The deformation chamber 5 is provided with a base surface 9 oriented at right angles to the longitudinal axis 8 of the projectile and the inside cross section of the deformation chamber 5 is substantially larger than that of the nozzle bore 3. Generally, it is advantageous to provide that the smallest inside diameter of the deformation chamber 5 has a relation to the inside diameter of the bore 3 of about 3:1 to 6:1 with the smallest inside diameter of the diameter of the deformation chamber having a relation to the caliber of the projectile of approximately 0.25:1 to 0.75:1. As shown, the wall thickness of the projectile increases in the deformable zone 6 toward the rear, but is yet, in total, substantially smaller in this region that in the region of the nozzle bore 3. Although the projectile body 1 is illustrated with an ogival outer shape at the front end, the body can also be constructed, for example, to be conical, cylindrical, or the like. The forward end face 10 of the projectile body 1 is a narrow annular surface, but can also be constructed to be sharp-edged, for example, by making the wall 7 of the deformation chamber 5, for instance, with a greater inclination.

Figure 1B:
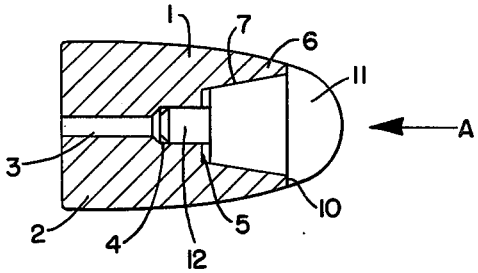

FIG. 1*b* shows the complete projectile with the cover or cap 11 inserted therein, the cap being shown in a plan view. The cap 11 is held in the transition bore 4 by a cylindrical pin 12 thereof engaging the wall of the bore. The cap completely extends over the deformation chamber 5 and completes the projectile so that it has a customary external shape. The cap 11 is made of an impact-resistant, difficult-to-deform synthetic resin, for example, PVC. In this embodiment, the cover fills the deformation chamber 5 practically completely.

The detachable cap 11 projects the front end face 10 of the projectile body 1 from damage and deformations, specifically during the feeding of the cartridges from the magazine into the cartridge chamber in the case of automatic firearms. During firing, the detachable cover 11 is readily driven out of the projectile due to the action of the propellant gases and exits from the barrel in front of the projectile body 1, which projectile body moves at a lower speed. Due to a low ballistic coefficient, the cap drops to the ground, all of its energy consumed, at a distance of a few meters in front of the barrel of the firearm, depending on its velocity.

Figure 4:
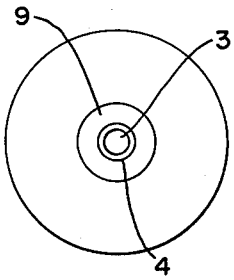
FIG. 4 is an end view of the projectile in the direction of arrow B in FIG. 3.
Figure 3:
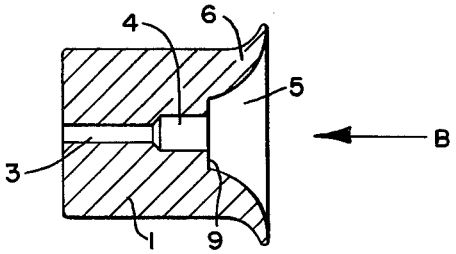
FIG. 3 shows the deformed projectile after impingement on a soft target, in a longitudinal sectional view.

FIGS. 3 and 4 show the projectile after impingement on soft targets. The deformation chamber 5, represented by the indentation having the shape of a truncated cone at the front end of the projectile, is filled during impingement on soft targets with portions of this medium, which displaces by radially directed force the projectile material of the deformable zone 6. Thereby, the material is bent toward the rear and a uniform enlargement of the cross section is produced, the size of which is, inter alia, a function of target velocity of the projectile, the resistance of the target medium, and the configuration of the deformation chamber 5 of the projectile body 1. In the case of projectiles utilized for cartridges having relative low projectile velocities, it is possible to provide in place of the truncated-cone indentation also, for example, a cylindrical indentation to keep the wall thickness of the zone 6 of the projectile body 1 at a minimum, whereby a lower resistance is offered against deformation.

Figure 6:
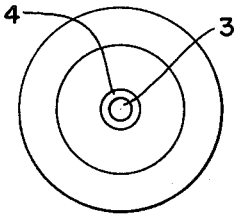
FIG. 6 is an end view of the projectile in the direction of arrow C in FIG. 5.
Figure 5:
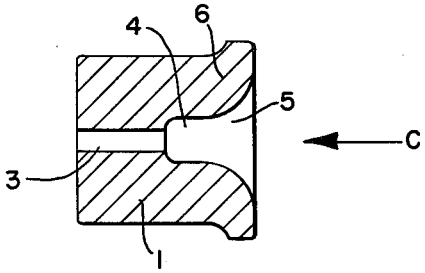
FIG. 5 shows the deformed projectile after impingement on a hard target, in a longitudinal sectional view.

FIGS. 5 and 6 show the projectile after impingement on hard targets. The material of zone 6 is axially deformed when hard targets are hit, whereby the projectile body 1 is compressed so that its length is greatly reduced and its cross-sectional area is only insubstantially enlarged.

Figure 7:
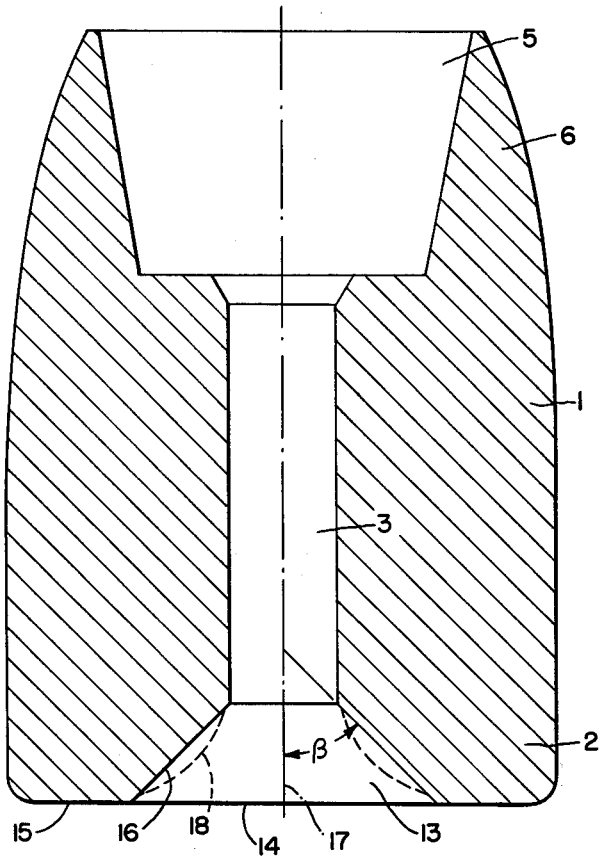
FIG. 7 shows a projectile without a cap in a longitudinal sectional view on an enlarged scale.

The projectile, made, for example, of a copper alloy, as illustrated in FIG. 7 in an enlarged view includes a projectile body 1 with rear end 2, an axial bore 3, and a deformation chamber cavity 5 with a deformable zone 6 surrounding the chamber. In the zone of the rear end 2, an intake section 13 is formed having an inlet opening 14 at the bottom side of this intake section which, in the illustrated arrangement, has an area about eight times as large as the inside cross section of the cylindrical bore 3, the diameter of which is, in this arrangement, for example, 1.8 mm with a projectile caliber of 9 mm. The ratio of the diameter of the inlet opening of the intake section on the bottom side to the diameter of the axial bore should be between about 1.5:1 and 4.5:1 and is preferably about 2.5:1 to 3.5:1. The intake section 13 has a wall 16 which tapers conically toward the front from the bottom 15 of the projectile. The angle of inclination $\beta$ of the wall 16 with respect to the longitudinal axis 17 of the projectile is in this case 45°. The angle of inclination $\beta$ may be between about 25° to 65° and preferably is between about 35° to 55°. The dashed line 18 indicates a curved wall of the intake section 13, which could be utilized, for example, in place of the conical wall 16.

Figure 8:
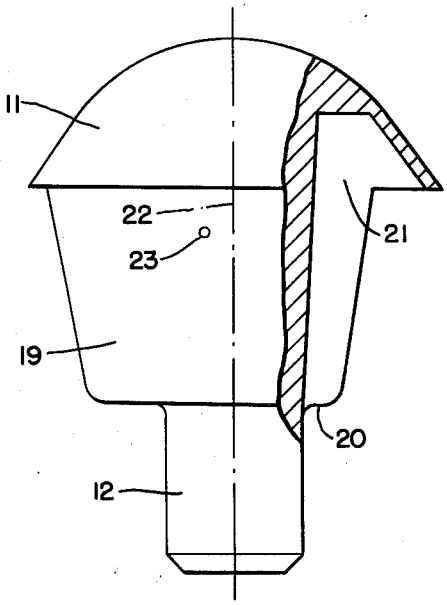
FIG. 8 shows the separate cap in a plan view and partially in section, likewise on an enlarged scale.
Figure 9:
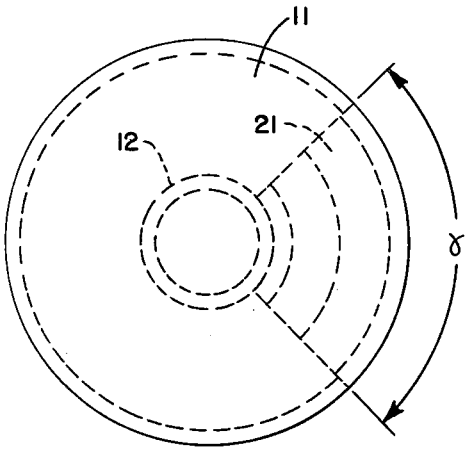
FIG. 9 shows the cap in a top view.

FIG. 8 shows the cap 11 with the pin 12 for a frictional connection in the axial bore 3 of the projectile body 1. The middle zone 19 of the cap 11 is dimensioned so that it fills, in the mounted condition of the cap 11, the deformation cavity 5 of the projectile body 1 at least approximately completely. The inner cavity 21 emanates from the rear end 20 of the cover 11, which latter is injection-molded, for example, from polystyrene. According to FIG. 9, the inner cavity 21 extends around the pin 12 over an angle $\gamma$ of, for example, 90° and locates the intended position of the center of gravity outside of the longitudinal axis 22. The positions of the center of gravity is indicated herein merely schematically by the point 23. Additionally, by the provision of the cavity 21, the cap is not rotationally symmetric.

While we have shown and described several embodiments in accordance with the present invention, it is understood that the same is not limited thereto but is susceptible of numerous changes and modifications as known to those skilled in the art and we therefore do not wich to be limited to the details shown and described herein but intend to cover all such changes and modifications as are encompassed by the scope of the appended claims.

We claim:

1. A projectile for hand and long firearms comprising a projectile body having a longitudinal axis, a front face and a rear face, deformation cavity means extending partially into the projectile body at the front face thereof, continuous axial bore means provided in the projectile body in communicating relationship with the rear face and the deformation cavity means, the projectile body having a wall thickness in the region surrounding the deformation cavity means which is substantially smaller than the wall thickness in the region surrounding the axial bore means, and cap means initially disposed in the region of the front face of the projectile body for covering at least the deformation cavity means, the cap means being separated from the projectile body within the barrel of the firearm during firing of the projectile and exiting from the barrel in front of the projectile body, the projectile body being configured such that the projectile body upon impingement on a soft target is radially expanded in the region surrounding the deformation cavity means so that the projectile body is substantially enlarged in cross section whereas the projectile body upon impingement on a hard target is radially expanded to a smaller extent and axially compressed to a larger extent in the region surrounding the deformation cavity means than upon impingement on a soft target.

2. A projectile according to claim 1, wherein the deformation cavity means is of substantially cylindrical configuration.

3. A projectile according to claim 2, wherein the deformation cavity means is at least partially delimited at the rearward portion thereof by a base surface oriented at right angles to the longitudinal axis of the projectile body.

4. A projectile according to claim 1, wherein the deformation cavity means is of substantially truncated cone configuration, the cone configuration flaring outwardly toward the front face of the projectile body.

5. A projectile according to claim 4, wherein the deformation cavity means is at least partially delimited at the rearward portion thereof by a base surface oriented at right angles to the longitudinal axis of the projectile body.

6. A projectile according to claim 5, wherein the conical surface of the truncated cone configuration has an angle of inclination with respect to the longitudinal axis of the projectile body of about 15°.

7. A projectile according to claim 1, wherein the projectile body is provided with a transition bore means between and in communicating relationship with the axial bore means and the deformation cavity means, the transition bore means having an inside cross section larger than the inside cross section of the axial bore means and smaller than the smallest inside cross section of the deformation cavity means.

8. A projectile according to claim 7, wherein the cap means is provided with a rearwardly extending pin member for engagement within the transition bore means.

9. A projectile according to claim 1, wherein the projectile body includes an intake section for propellant gases at the rear end face communicating with the axial bore means, the intake section having an inlet opening at the rear end face provided with an inside cross section which is larger than the inside cross section of the axial bore means, the inside cross section of the intake section decreasing in the forward direction from the size at the inlet opening at the rear end face to the size of the inside cross section of the axial bore means.

10. A projectile according to claim 9, wherein the inside cross section continuously decreases.

11. A projectile according to claim 9, wherein the inlet opening of the intake section at the rear side of the projectile body has a relation to the diameter thereof with respect to the diameter of the axial bore means of between about 1.5:1 and 4.5:1.

12. A projectile according to claim 11, wherein the ratio of the diameter of the inlet opening of the intake section to the diameter of the axial bore means is between about 2.5:1 to 3.5:1.

13. A projectile according to claim 9, wherein the intake section is provided with a conical surface wall configuration.

14. A projectile according to claim 13, wherein the conical wall of the intake section has an angle of inclination of the conical surface thereof with respect to the longitudinal axis of the projectile body of between about 25° and 65°.

15. A projectile according to claim 14, wherein the angle of inclination of the conical surface with respect to the longitudinal axis of the projectile body is between about 35° to 55°.

16. A projectile according to claim 9, wherein the intake section is provided with a curved surface wall configuration.

17. A projectile according to claim 1, wherein the cap means is provided with a center of gravity lying outside of the longitudinal axis of the projectile body.

18. A projectile according to claim 17, wherein the cap means is provided with a non-rotationally symmetric cross section.

19. A projectile according to claim 8, wherein the cap means is provided with a center of gravity lying outside of the longitudinal axis of the projectile body.

20. A projectile according to claim 9, wherein the cap means is provided with a center of gravity lying outside of the longitudinal axis of the projectile body.

21. A projectile according to claim 6, wherein the projectile body includes an intake section for propellant gases at the rear end face communicating with the axial bore means, the intake section having an inlet opening at the rear end face provided with an inside cross section which is larger than the inside cross section of the axial bore means, the inside cross section of the intake section decreasing in the forward direction from the size at the inlet opening at the rear end face to the size of the inlet cross section of the axial bore means.

22. A projectile according to claim 21, wherein the deformation cavity means is of substantially cylindrical configuration.

23. A projectile according to claim 22, wherein the deformation cavity means is of substantially truncated cone configuration, the cone configuration flaring outwardly toward the front face of the projectile body.

24. A projectile according to claim 23, wherein the cap means is provided with a center of gravity lying outside of the longitudinal axis of the projectile body.

25. A projectile according to claim 1, wherein the deformation cavity means has a relation of the smallest inside diameter thereof to the inside diameter of the axial bore means of between about 3:1 to 6:1.

26. A projectile according to claim 1, wherein the deformation cavity means has a relation of the smallest inside diameter thereof to the caliber of the projectile of between about 0.25:1 to 0.75:1.

27. A projectile according to claim 1, wherein the projectile body is an unjacketed member.

28. A projectile according to claim 1, wherein the axial bore means is provided with an inside cross section sufficient to enable gas flow therethrough for effecting separation of the cap means from the projectile body without substantially reducing the range of the projectile body.

29. A projectile according to claim 1, wherein the deformation cavity means is responsive to the soft target material accumulating in the deformation cavity means upon impingement of the projectile body on a soft target for radially expanding the projectile body in the region surrounding the deformation cavity means.

* * * * *